US009586426B1

(12) United States Patent
Spence

(10) Patent No.: US 9,586,426 B1
(45) Date of Patent: Mar. 7, 2017

(54) PROFILE PRINTING WITH CAM FOLLOWERS AND TEMPLATE GUIDES

(71) Applicant: Xerox Corporation, Norwalk, CT (US)

(72) Inventor: James Spence, Honeoye Falls, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/094,647

(22) Filed: Apr. 8, 2016

(51) Int. Cl.
*B41J 3/407* (2006.01)
*B41J 25/308* (2006.01)

(52) U.S. Cl.
CPC ..... *B41J 25/308* (2013.01); *B41J 3/4073* (2013.01)

(58) Field of Classification Search
CPC ..... B41J 25/308; B41J 3/4073
See application file for complete search history.

(56) References Cited

U.S. PATENT DOCUMENTS 5,074,685 A * 12/1991 Shimizu ..... B41J 11/20 400/56
2005/0045083 A1* 3/2005 Canan ..... D05B 11/00 112/117
2005/0285919 A1* 12/2005 Martinez ..... B41J 3/4073 347/101
2008/0055348 A1* 3/2008 Deeter ..... B41J 3/4073 347/9

* cited by examiner

*Primary Examiner* — Stephen Meier
*Assistant Examiner* — Alexander D Shenderov

(57) ABSTRACT

An apparatus, method and non-transitory computer readable medium for printing on a profile of a printing medium having an irregular surface are disclosed. For example, the apparatus includes a print bar having one or more print heads, a shuttle, a loading carriage for holding the printing medium, wherein the loading carriage is coupled to the shuttle, a profile template coupled to the loading carriage via a cam follower and a controller coupled to the print bar and the shuttle, wherein the controller controls movement of the shuttle to cause the cam follower to move the loading carriage along a path that follows the profile of the printing medium and maintain a minimum print head gap during printing between the one or more print heads and the profile of the printing medium.

20 Claims, 7 Drawing Sheets

PROFILE PRINTING WITH CAM FOLLOWERS AND TEMPLATE GUIDES

The present disclosure relates generally to printing on irregular surfaces and, more particularly, to a method and apparatus for profile printing with cam followers and template guides.

BACKGROUND

As printing and ink technology improve, ink based printing machines are being used to print on a larger variety of objects and mediums other than paper. Printing on paper is a fairly straight forward process as paper has a typically flat and even surface. As a result, a print head can maintain an optimal print head gap to the paper during printing.

A proper print head gap is one of the factors that determines how well the image can be printed onto a medium. When the print head gap between the print head and the medium being printed on is not optimal, influences acting on the ink droplets or degradation of the ink droplets may reduce image quality. For example, the farther away the print head and surface being printed on are, the greater the loss of image quality.

Printing onto contoured or profiled surfaces can be challenging. Objects that have an irregular surface, or uneven geometry, may have non-parallel or non-coplanar conditions between the print head and the surface of the medium or part that is receiving the ink droplets. As a result, printing on irregular surfaces using traditional ink based printing machines may suffer in poor image quality due to the variation of print head gap.

SUMMARY

According to aspects illustrated herein, there are provided an apparatus, a method and a non-transitory computer readable medium for printing on a profile of a printing medium having an irregular surface. One disclosed feature of the embodiments is an apparatus that includes a print bar having one or more print heads, a shuttle, a loading carriage for holding the printing medium, wherein the loading carriage is coupled to the shuttle, a profile template coupled to the loading carriage via a cam follower and a controller coupled to the print bar and the shuttle, wherein the controller controls movement of the shuttle to cause the cam follower to move the loading carriage along a path that follows the profile of the printing medium and maintain a minimum print head gap during printing between the one or more print heads and the profile of the printing medium.

Another disclosed feature of the embodiments is a method that receives a confirmation that a profile template that matches the profile of the printing medium is coupled to a cam follower that is coupled to a loading carriage that holds the printing medium and that the printing medium is loaded onto the loading carriage, controls a shuttle to move the loading carriage in accordance with the profile template and controls one or more print heads to dispense ink onto the profile of the printing medium when a portion of the profile of the printing medium is moved under the one or more print heads at a minimum print head gap by the cam follower moving along the profile template.

Another disclosed feature of the embodiments is a non-transitory computer-readable medium having stored thereon a plurality of instructions, the plurality of instructions including instructions which, when executed by a processor, cause the processor to perform operations that receive a confirmation that a profile template that matches the profile of the printing medium is coupled to a cam follower that is coupled to a loading carriage that holds the printing medium and that the printing medium is loaded onto the loading carriage, control a shuttle to move the loading carriage in accordance with the profile template and control one or more print heads to dispense ink onto the profile of the printing medium when a portion of the profile of the printing medium is moved under the one or more print heads at a minimum print head gap by the cam follower moving along the profile template.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

The present disclosure broadly discloses an apparatus and method for printing on a profile of a printing medium having an irregular surface. As discussed above, ink based printing machines are being used to print on a larger variety of objects and mediums other than paper. Printing onto contoured or profiled surfaces can be challenging. Objects that have an irregular surface, or uneven geometry, may have non-parallel or non-coplanar conditions between the print head and the surface of the medium or part that is receiving the ink droplets. As a result, printing on irregular surfaces using traditional ink based printing machines may suffer in poor image quality due to the variation of print head gap.

Embodiments of the present disclosure provide an apparatus that provides an efficient, relatively low cost and mechanical solution to maintaining a minimum print head gap when printing onto irregular surfaces. For example, a profile template may be fabricated that has a path that corresponds to a profile of the irregular surface of a printing medium. The path may be deployed by a slot that has portions that outline the profile of the printing medium.

A carriage may be coupled to the profile template via a cam follower that is placed through the slot of the profile template. As a shuttle moves the carriage, the cam follower may follow the path on the profile template. The path on the profile template may cause the cam follower to move such that the printing medium is within the minimum print head gap relative to a print head during a printing process.

Figure 1:
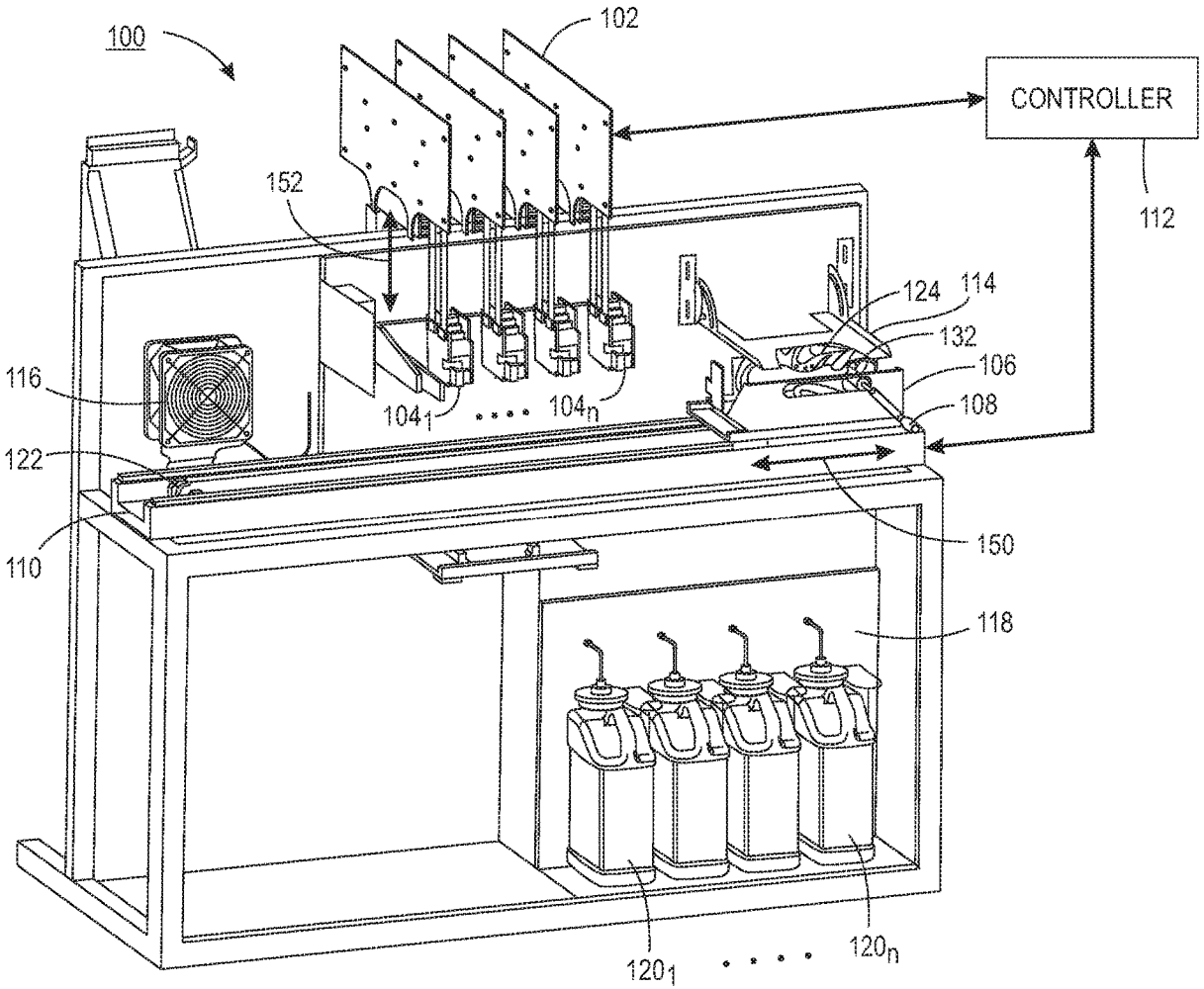
FIG. 1 illustrates an example apparatus of the present disclosure.

FIG. 1 illustrates an example apparatus 100 of the present disclosure. In one embodiment, the apparatus 100 may include a print bar 102 comprising one or more print heads $\mathbf{104}_1$ to $\mathbf{104}_n$ (herein after referred to individually as a print head 104 or collectively as print heads 104). In one embodiment, the one or more print heads 104 may dispense different colored inks. For example, the apparatus 100 may include an ink bottle loading area 118 where a plurality of different colored inks $\mathbf{120}_1$ to $\mathbf{120}_n$ are stored (herein also referred to individual as ink 120 or different colored inks 120). The different inks colored inks 120 may be fed to a respective print head 104. In one embodiment, the different colored inks 120 may include colors, such as, cyan, yellow, magenta and black.

In one embodiment, the print heads 104 may be individually coupled to the print bar 102 such that the print heads 104 may each move vertically up and down. For example, an arrow 152 may illustrate an example of movement up and down. For example, if a first color is to be dispensed by print head $\mathbf{104}_n$, the other print heads 104 may be moved vertically upwards to be out of the way. When a second color is to be dispensed by a print head $\mathbf{104}_{n-1}$, then the print head $\mathbf{104}_n$ may be moved vertically upwards and the print head $\mathbf{104}_{n-1}$ may be moved vertically downward.

In one embodiment, the apparatus 100 may include a shuttle 110. The shuttle 110 may include a drive belt 122 that moves laterally or left and right. For example, an arrow 150 illustrates directions of lateral movement or moving left and right.

In one embodiment, a loading carriage 106 may be placed onto, or coupled, to the shuttle 110. In one embodiment, the shuttle 110 may move the loading carriage 106 laterally or left to right as shown by the arrow 150. In other words, the loading carriage 106 may move on an axis that is along a length, or parallel to a length, of the shuttle 110. The loading carriage 106 may have a tray or opening to hold a printing medium 124.

The printing medium 124 may be any type of three dimensional object that has an irregular surface, or irregular geometry, that will receive a printed image. In one embodiment, the printing medium 124 may have a profile (a side that runs along a length of the printing medium 124) that will be printed on with the one or more print heads 104. An example of a printing medium 124 may include a shoe, a toy, a piece of sporting equipment, a sculpture, and the like. However, it should be noted that any three dimensional object (e.g., fabric, wood, glass, leather, plastic, and the like) that has an irregular surface contour along a profile of the object can be used as a printing medium 124.

Figure 2:
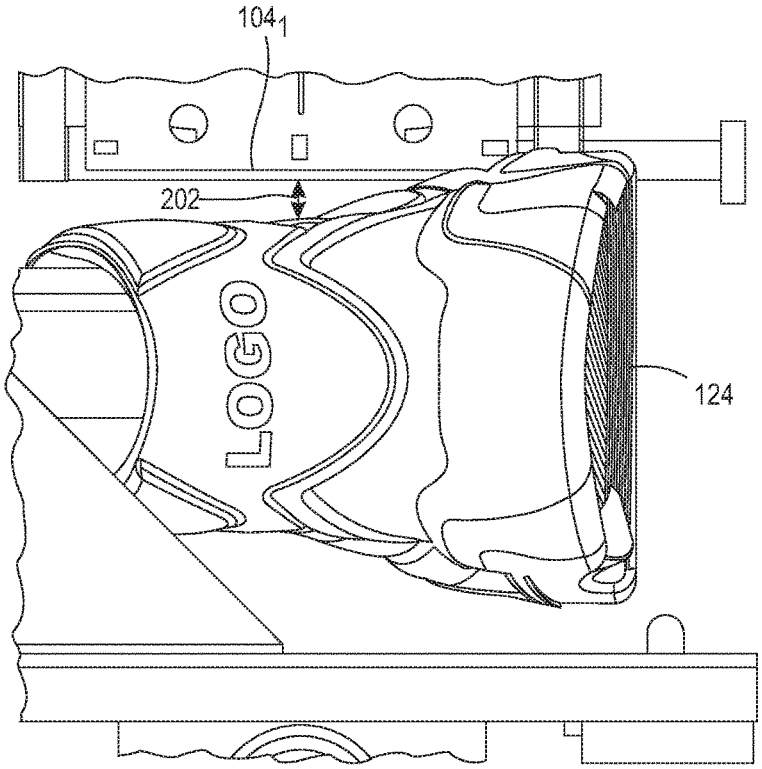
FIG. 2 illustrates an example of a print head gap.

As discussed above, if only the loading carriage 106 were used to move the printing medium 124 under the one or more print heads 104, variations in the print head gap would lead to poor image quality. FIG. 2 illustrates an example of a minimum print head gap 202 between a print head $\mathbf{104}_1$ and a surface of the profile of the printing medium 124. The minimum print head gap 202 may be a distance between a bottom of the print head $\mathbf{104}_1$ (e.g., a bottom surface of a nozzle plate of the print head $\mathbf{104}_1$) and a top surface of a portion of the printing medium 124 that is below the print head $\mathbf{104}_1$. In one embodiment, the minimum print head gap 202 may be approximately 1 millimeter (mm) to 2 mm.

Figure 3:
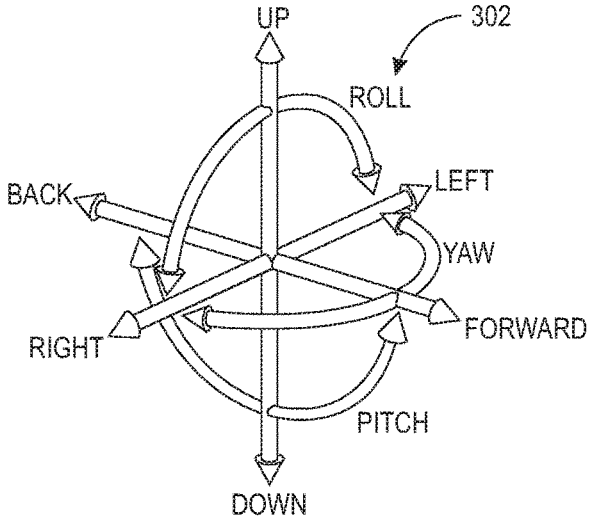
FIG. 3 illustrates an example of an axis of possible movement of an irregular surface.

To maintain the minimum print head gap 202, the loading carriage 106 should be able to manipulate or move the printing medium 124 in a variety of different directions. For example, FIG. 3 illustrates an example axis of movement 302. The loading carriage 106 should be able to move the printing medium 124 in any one of the six directions illustrated by the axis of movement 302.

Figure 4:
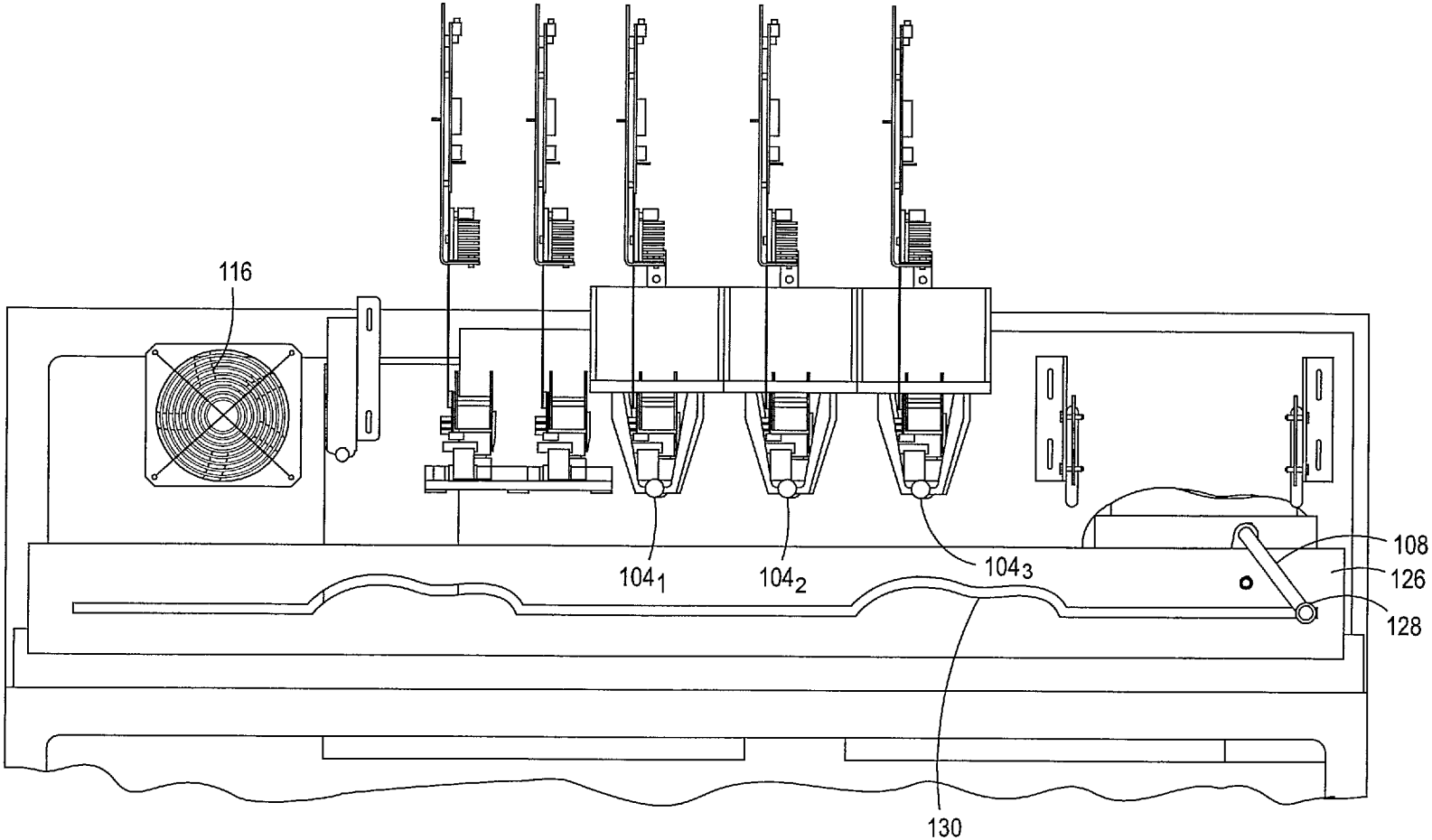
FIG. 4; illustrates an example of a profile template on the apparatus.

In one embodiment, a profile template 126 (also referred to as a template guide) as illustrated in FIG. 4 can be used to guide the movement of the printing medium 124 in the loading carriage 106 in any one of the directions illustrated by the axis of movement 302. In addition, the profile template 126 may guide the movement of the printing medium 124 such that each portion of the profile of the printing medium 124 that is printed on will maintain the minimum print head gap 202 between the profile of the printing medium 124 and a respective print head 104.

In one embodiment, the loading carriage 106 may be coupled to a profile template 126 via a cam follower 108 as illustrated in FIG. 4. The profile template 126 may be fabricated from a metal and coupled to a front side of the shuttle 110. For example, one or more bolts, screws, or other types of mechanical fasteners may be used to secure the profile template 126 to the shuttle 110. The profile template 126 may have a length that is approximately equal to a length of the shuttle 110.

In one embodiment, the profile template 126 may include a path that is formed by a slot 128. In one embodiment, a width of the slot 128 may be approximately equal to a width of the cam follower 108. In one embodiment, the cam follower 108 may be inserted through the slot 128 to couple the loading carriage 106 to the profile template 126. As a result, the movement of the loading carriage 106 may be limited, or guided, by the path of the slot 128.

In one embodiment, a portion 130 of the profile template 126 may have a slot 128 that is similar to the profile of the printing medium 124. In other words, the path of the portion 130 of the slot 128 may have a contour or an outline that is the same as the profile of the printing medium 124.

Figure 5:
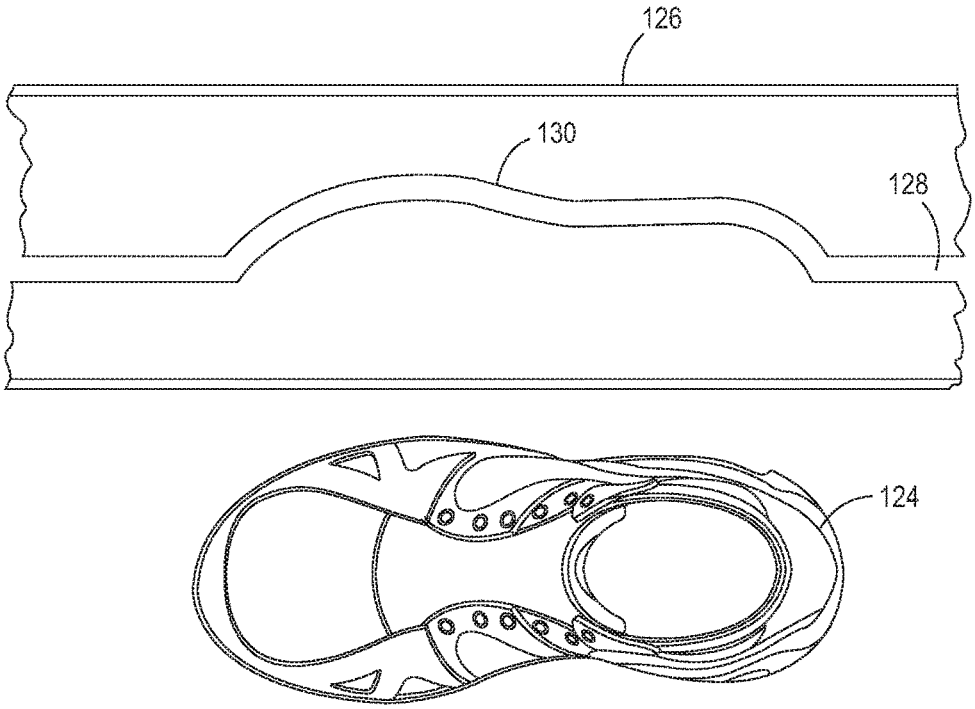
FIG. 5; illustrates an example of a profile in a profile template.

FIG. 5 illustrates an example that uses a shoe as the printing medium 124. For example, a customer may want to print an image or images along a right side profile of the printing medium 124. A profile template 126 may be fabricated that has a portion 130 of the slot 128 that follows the same contour, shape, or outline of the right side profile of the printing medium 124. In one embodiment, a 3D sensor may be used to map the contour of the profile of the printing medium 124 and the slot 128 may be cut by a laser that matches the contour that is mapped.

In one embodiment, the slot 128 may be cut flat or at an angle. For example, to change a pitch of the surface of the printing medium 124, as shown by the axis of movement 302, the slot 128 may have a have a ramp up or a dip down. To change a roll or the yaw of the surface of the printing medium 124, the slot 128 may be cut at an angle towards the page or away from the page. The back and forward movement and the up and down movement may be controlled by the path of the slot 128 and a height of the slot 128 within the profile template 126.

In one embodiment, a plurality of profile templates 126 may be fabricated for each one of a plurality of different profiles of different printing mediums 124 that are used. As a result, as different printing mediums 124 are loaded into the loading carriage 106 for printing, a corresponding profile template 126 may be coupled to the loading carriage 106 and the shuttle 110.

In one embodiment, a profile template 126 may also be fabricated for the one or more print heads 104. For example, as described above, each one of the print heads 104 may be coupled to the print bar 102 to allow for vertical movement up or down. A different profile template 126 may be coupled to each one of the print heads 104 to control the movement of the print heads 104 relative to the printing medium 124. For example, the print heads 104 may move up and down individually similar to "piano keys" during printing as different colored inks 120 are applied to different portions of the printing medium 124.

Referring back to FIG. 1, the cam follower 108 may also include an attachment mechanism 132. In one embodiment, the attachment mechanism 132 may be used to hold the printing medium 124 at a fixed position during printing. For example, slight movements (e.g., sliding forward or backward) of the printing medium 124 may cause a misalignment with the print heads 104. In one embodiment, the attachment mechanism may be a rod that is inserted into a shoe and coupled to the cam follower 108. In another embodiment, the attachment mechanism 132 may be a claw for a circular object, and the like.

In one embodiment, the attachment mechanism 132 may rotate or be connected to the cam follower via a ball joint to allow for the freedom of movements as shown by the axis of movement 302. For example, a ball joint may allow the attachment mechanism 132 to roll, bend or move with any changes is angle, slope or elevation of the slot 128 that is cut into the profile template 126.

In one embodiment, the apparatus 100 may also include an alignment mechanism 114. The loading carriage 106 may be adjusted vertically up and down to allow for alignment to the alignment mechanism 114. For example, the alignment mechanism may fold up when not in use, or fold down to perform the alignment.

In one embodiment, a bottom surface of the alignment mechanism 114 may be co-planar with a bottom surface of the print heads 104. As a result, the alignment mechanism may ensure that the printing medium 124 is aligned with the print heads 104 such when the loading carriage 106 is moved along the profile template 126, the minimum print head gap 202 will be maintained during printing on all surfaces of the profile of the printing medium 124.

In one embodiment, the apparatus 100 may also include an exhaust fan 116. For example, some applications may require inks 120 that are volatile and emit vapors. The exhaust fan 116 may remove any harmful vapors emitted by the different colored inks 120.

In one embodiment a controller 112 may be in communication with the print heads 104 coupled to the print bar 102 and the shuttle 110. The controller 112 may control the speed and movement of the belt drive 122 to allow move the loading carriage 106 along the profile template 126. The controller 112 may also control the movement of the print heads 104 and the color ink 120 that is dispensed by a particular print head.

In one embodiment, the controller 112 may comprise a processor and a non-transitory computer readable medium that stores instructions that are executed by the processor. In one embodiment, the controller 112 may include an input/output interface that allows a user to provide input signals to indicate that the print medium 124 is loaded into the loading carriage 106, the print medium 124 and the loading carriage 106 is aligned with the print heads 104, and the like.

Figure 6:
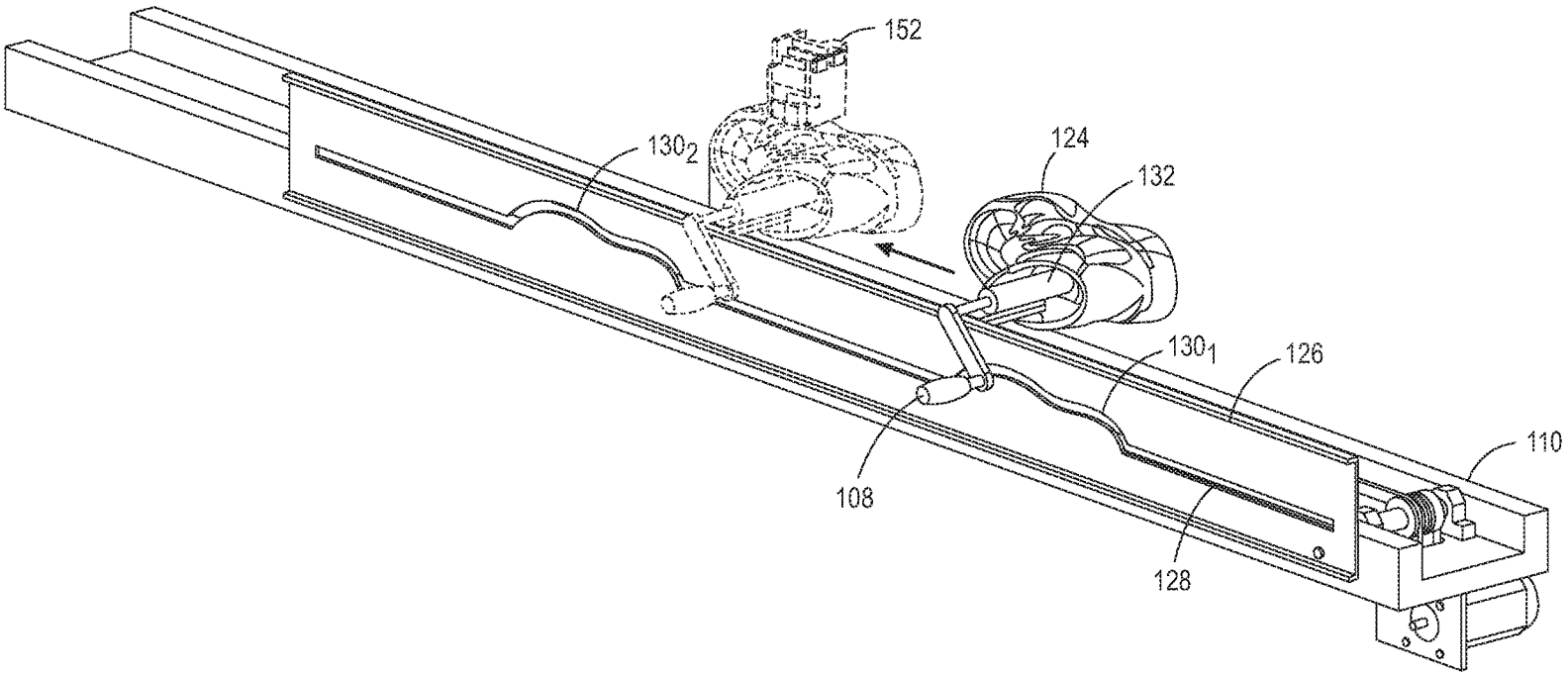
FIG. 6; illustrates an example of a cam follower moving in a profile template.

FIG. 6 illustrates another example of a profile template 126 and an example of the cam follower 108 moving in the profile template 126. FIG. 6 illustrates phantom lines 152 that show how the cam follower 108 is guided along the portion $\mathbf{130}_2$ as the cam follower 108 moves along the slot 128.

In one embodiment, the profile template 126 may include a plurality of portions $\mathbf{130}_1$ and $\mathbf{130}_2$ For example a different set of print heads 104 may be located at the portions $\mathbf{130}_1$ and $\mathbf{130}_2$. The different colored ink 120 may be dispensed at the different portions $\mathbf{130}_1$ and $\mathbf{130}_2$.

In one embodiment, the different portions $\mathbf{130}_1$ and $\mathbf{130}_2$ may be used to achieve a particular resolution. For example, the print heads 104 may print in a 300 dots per inch (dpi) resolution. If the desired resolution is 600 dpi, the printing medium 124 may be passed through the portions $\mathbf{130}_1$ and $\mathbf{130}_2$ to achieve the 600 dpi resolution.

Figure 7:
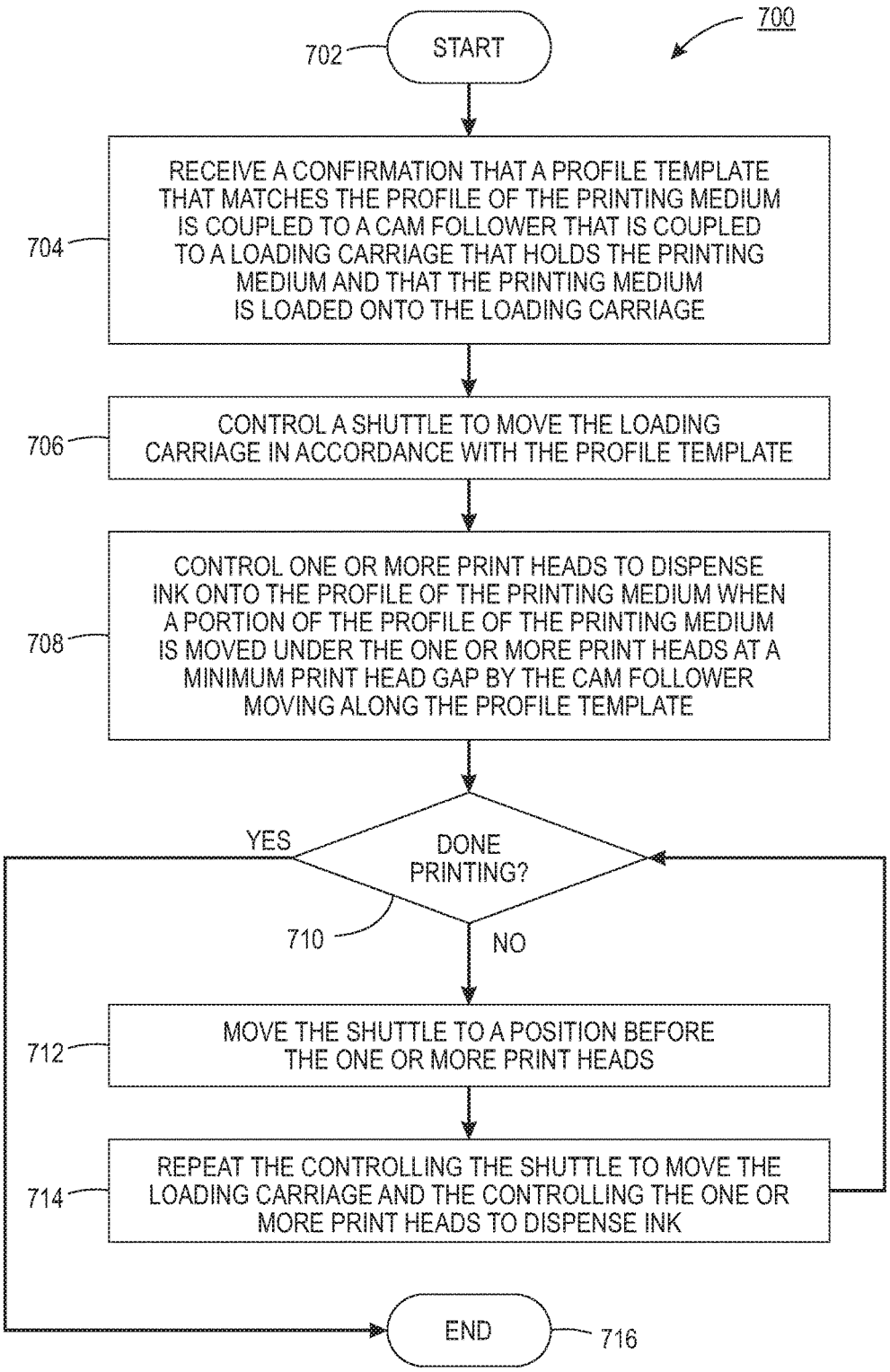
FIG. 7 illustrates a flowchart of an example method for printing on an irregular surface.
Figure 8:
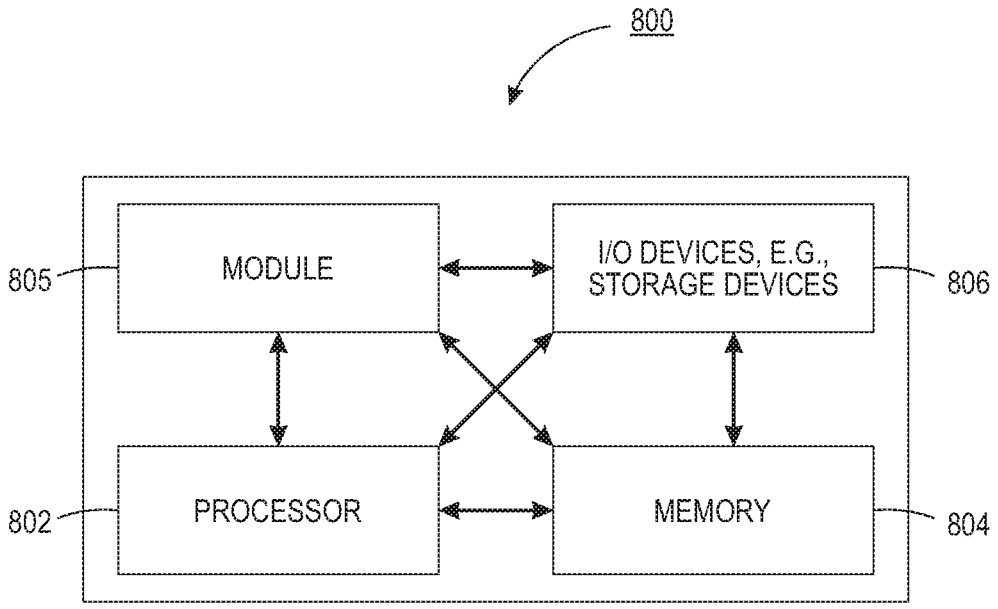
FIG. 8 illustrates a high-level block diagram of a computer suitable for use in performing the functions described herein.

FIG. 7 illustrates a flowchart of an example method 700 for printing on an irregular surface. In one embodiment, one or more steps or operations of the method 700 may be performed by the apparatus 100 or a computer as illustrated in FIG. 8 and discussed below.

At block 702, the method 700 begins. At block 704, the method 700 receives a confirmation that a profile template that matches the profile of the printing medium is coupled to a cam follower that is coupled to a loading carriage that holds the printing medium and that the printing medium is loaded onto the loading carriage. For example, a user may select a profile template that has a slot that is cut with a portion of the slot that follows the contour of the profile of the printing medium (e.g., a side of a shoe). The profile may be secured to a front side of a shuttle that moves the loading carriage. The user may then place the printing medium in the loading carriage and couple the loading carriage to the profile template using a cam follower that is inserted through the slot of the profile template. The user may then send a signal or a notification to a controller of the printing apparatus via a user interface (e.g., a touchscreen interface, a monitor and keyboard, and the like). The notification that is received by the controller may indicate that the profile template is secured and that the printing medium is loaded into the loading carriage.

In one embodiment, a user may also perform an alignment with an alignment mechanism. For example, the user may align the loading carriage and the printing medium with one or more print heads of the printing apparatus to ensure that all portions of the profile of the printing medium are within a minimum print head gap during printing. The notification sent by the user via the user interface may also indicate that the alignment has been completed.

At block 706, the method 700 controls a shuttle to move the loading carriage in accordance with the profile template. For example, a belt drive of the shuttle may begin moving the loading carriage laterally. However, the movement may be guided by a path of the slot of the profile template. The cam follower that is coupled to the loading carriage may move in any one of six different axis of movement depending on the path, slope and angle of the slot that is cut into the profile template.

At block 708, the method 700 controls one or more print heads to dispense ink onto the profile of the printing medium when a portion of the profile of the printing medium is moved under the one or more print heads at a minimum print head gap by the cam follower moving along the profile template. For example, a print head associated with a particular color may be moved into a position that is within the minimum print head gap distance relative to a portion of the printing medium that is receiving the ink. In another embodiment, the print heads may be stationary and the controller may simply dispense the appropriate colored ink via the respective print head.

At block 710, the method 700 determines if printing is completed. If the printing is completed, then the method 700 may proceed to block 716 where the method 700 ends. However, if the printing is not completed, the method 700 may proceed to block 712. For example, multiple passes under the print heads may be used to achieve a desired resolution, print different images, print different colors, and the like.

At block 712, the method 700 moves the shuttle to a position before the one or more print heads. For example, the loading carriage may be moved laterally backwards to a position before the print heads. In other words, if the forward direction of the shuttle moves the loading carriage from right to left, then moving the loading carriage backwards would cause the shuttle to move the loading carriage from left to right.

At block 714, the method 700 repeats the controlling the shuttle to move the loading carriage and the controlling the one or more print heads to dispense ink. Once the loading carriage is moved into position for another pass of printing, the loading carriage may be moved forward again under the print heads and ink may be dispensed onto the appropriate portions of the printing medium. The method may then return to block 710 to determine if printing is completed.

It should be noted that although not explicitly specified, one or more steps, functions, or operations of the method 700 described above may include a storing, displaying and/or outputting step as required for a particular application. In other words, any data, records, fields, and/or intermediate results discussed in the methods can be stored, displayed, and/or outputted to another device as required for a particular application. Furthermore, steps, functions, or operations in FIG. 7 that recite a determining operation, or involve a decision, do not necessarily require that both branches of the determining operation be practiced. In other words, one of the branches of the determining operation can be deemed as an optional step.

FIG. 8 depicts a high-level block diagram of a computer that can be transformed to into a machine that is dedicated to perform the functions described herein. As a result, the embodiments of the present disclosure improve the operation and functioning of a controller to control printing on an irregular surface that uses cam followers and template guides, as disclosed herein.

As depicted in FIG. 8, the computer 800 comprises one or more hardware processor elements 802 (e.g., a central processing unit (CPU), a microprocessor, or a multi-core processor), a memory 804, e.g., random access memory (RAM) and/or read only memory (ROM), a module 805 for printing on an irregular surface, and various input/output devices 806 (e.g., storage devices, including but not limited to, a tape drive, a floppy drive, a hard disk drive or a compact disk drive, a receiver, a transmitter, a speaker, a display, a speech synthesizer, an output port, an input port and a user input device (such as a keyboard, a keypad, a mouse, a microphone and the like)). Although only one processor element is shown, it should be noted that the computer may employ a plurality of processor elements. Furthermore, although only one computer is shown in the figure, if the method(s) as discussed above is implemented in a distributed or parallel manner for a particular illustrative example, i.e., the steps of the above method(s) or the entire method(s) are implemented across multiple or parallel computers, then the computer of this figure is intended to represent each of those multiple computers. Furthermore, one or more hardware processors can be utilized in supporting a virtualized or shared computing environment. The virtualized computing environment may support one or more virtual machines representing computers, servers, or other computing devices. In such virtualized virtual machines, hardware components such as hardware processors and computer-readable storage devices may be virtualized or logically represented.

It should be noted that the present disclosure can be implemented in software and/or in a combination of software and hardware, e.g., using application specific integrated circuits (ASIC), a programmable logic array (PLA), including a field-programmable gate array (FPGA), or a state machine deployed on a hardware device, a computer or any other hardware equivalents, e.g., computer readable instructions pertaining to the method(s) discussed above can be used to configure a hardware processor to perform the steps, functions and/or operations of the above disclosed methods. In one embodiment, instructions and data for the present module or process 805 for printing on an irregular surface (e.g., a software program comprising computer-executable instructions) can be loaded into memory 804 and executed by hardware processor element 802 to implement the steps, functions or operations as discussed above in connection with the illustrative method 700. Furthermore, when a hardware processor executes instructions to perform "operations," this could include the hardware processor performing the operations directly and/or facilitating, directing, or cooperating with another hardware device or component (e.g., a co-processor and the like) to perform the operations.

The processor executing the computer readable or software instructions relating to the above described method(s) can be perceived as a programmed processor or a specialized processor. As such, the present module 805 for printing on an irregular surface (including associated data structures) of the present disclosure can be stored on a tangible or physical (broadly non-transitory) computer-readable storage device or medium, e.g., volatile memory, non-volatile memory, ROM memory, RAM memory, magnetic or optical drive, device or diskette and the like. More specifically, the computer-readable storage device may comprise any physical devices that provide the ability to store information such as data and/or instructions to be accessed by a processor or a computing device such as a computer or an application server.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus for printing on a profile of a printing medium having an irregular surface, comprising:

a print bar having one or more print heads;

a shuttle;

a loading carriage for holding the printing medium, wherein the loading carriage is coupled to the shuttle;

a profile template coupled to the loading carriage via a cam follower; and a controller coupled to the print bar and the shuttle, wherein the controller controls a movement of the shuttle to cause the cam follower to move the loading carriage along a path that follows the profile of the printing medium and maintain a minimum print head gap during printing between the one or more print heads and the profile of the printing medium.

2. The apparatus of claim 1, wherein the one or more print heads comprise a plurality of print heads, wherein each one of the plurality of print heads dispenses a different color ink.

3. The apparatus of claim 1, wherein the shuttle comprises a belt drive.

4. The apparatus of claim 3, wherein the belt drive moves the loading carriage laterally along a length of the shuttle.

5. The apparatus of claim 1, wherein the cam follower comprises an attachment mechanism to hold the printing medium in the loading carriage.

6. The apparatus of claim 1, wherein the profile template is located in front of the shuttle, wherein a length of the profile template is approximately equal to a length of the shuttle.

7. The apparatus of claim 1, wherein the profile template comprises a slot, wherein a width of the slot is approximately equal to a width of the cam follower.

8. The apparatus of claim 7, wherein the movement of the shuttle is limited to a path of the slot.

9. The apparatus of claim 1, further comprising:

an alignment mechanism.

10. The apparatus of claim 9, wherein a bottom side of the alignment mechanism is co-planar with a bottom tip of the one or more print heads.

11. The apparatus of claim 1, wherein the one or more print heads move vertically up and down.

12. The apparatus of claim 1, further comprising:

an exhaust fan.

13. A method for printing on a profile of a printing medium having an irregular surface, comprising:

receiving, via a processor, a confirmation that a profile template that matches the profile of the printing medium is coupled to a cam follower that is coupled to a loading carriage that holds the printing medium and that the printing medium is loaded onto the loading carriage;

controlling, by the processor, a shuttle to move the loading carriage in accordance with the profile template; and controlling, by the processor, one or more print heads to dispense ink onto the profile of the printing medium when a portion of the profile of the printing medium is moved under the one or more print heads at a minimum print head gap by the cam follower moving along the profile template.

14. The method of claim 13, further comprising:

moving, by the processor, the shuttle to a position before the one or more print heads; and repeating, by the processor, the controlling the shuttle to move the loading carriage and the controlling the one or more print heads to dispense ink.

15. The method of claim 14, wherein the repeating the controlling the one or more print heads to dispense ink is performed with different color inks.

16. The method of claim 13, wherein the confirmation further comprises that the printing medium in the loading carriage is aligned.

17. The method of claim 13, wherein the profile template comprises a slot, wherein a width of the slot is approximately equal to a width of the cam follower.

18. The method of claim 17, wherein a movement of the loading carriage is limited to a path of the slot.

19. An apparatus for printing on a profile of a printing medium having an irregular surface, comprising:

a print bar having a plurality of print heads, wherein each one of the plurality of print heads dispenses a different colored ink and is individually coupled to move vertically up and down;

a belt drive that moves laterally;

a loading carriage for holding the printing medium, wherein the loading carriage is coupled to the belt drive;

a profile template comprising a slot that has a path comprising a slot, wherein a portion of the path has a contour that follows the profile of the printing medium, wherein the profile template is coupled to the loading carriage via a cam follower that is inserted through the slot; and a controller coupled to the print bar and the belt drive, wherein the controller controls movement of the belt drive to cause the cam follower to move the loading carriage along the path of the slot and maintain a minimum print head gap during printing between the one or more print heads and the profile of the printing medium.

20. The apparatus of claim 19, further comprising:

an alignment mechanism.

* * * * *